US009676178B2

(12) United States Patent
Mondloch

(10) Patent No.: US 9,676,178 B2
(45) Date of Patent: Jun. 13, 2017

(54) PRINTER FOR PRINTING A FILM THAT CAN BE HYDROGRAPHICALLY PRINTED ONTO AN OBJECT AND A METHOD OF PRINTING

(71) Applicant: Einstein Graphic Services, LLC, Freedom, WI (US)

(72) Inventor: Steve J. Mondloch, Freedom, WI (US)

(73) Assignee: Einstein Graphic Services, LLC, Freedom, WI (US)

( * ) Notice: Subject to any disclaimer, the term of this patent is extended or adjusted under 35 U.S.C. 154(b) by 0 days.

(21) Appl. No.: 15/079,963

(22) Filed: Mar. 24, 2016

(65) Prior Publication Data

US 2016/0303846 A1 Oct. 20, 2016

Related U.S. Application Data

(60) Provisional application No. 62/147,114, filed on Apr. 14, 2015.

(51) Int. Cl.

| | |
|---|---|
| ***B41F 35/00*** | (2006.01) |
| ***B41F 23/04*** | (2006.01) |
| ***B41J 11/00*** | (2006.01) |

(52) U.S. Cl.

CPC ..... *B41F 23/04* (2013.01); *B41J 11/001* (2013.01); *B41J 11/002* (2013.01)

(58) Field of Classification Search

CPC ..... B41F 23/0426

(Continued)

(56) References Cited

U.S. PATENT DOCUMENTS

| | | | | |
|---|---|---|---|---|
| 923,242 | A | 6/1909 | Briggs | |
| 2,499,572 | A * | 3/1950 | Dunakin | B41F 23/0426 15/345 |

(Continued)

FOREIGN PATENT DOCUMENTS

| | | |
|---|---|---|
| CN | 101259803 | 9/2008 |
| CN | 201109230 | 9/2008 |

(Continued)

*Primary Examiner* — Anthony Nguyen

(74) *Attorney, Agent, or Firm* — Thomas J. Connelly; Northwind IP Law, S.C.

(57) ABSTRACT

A printer and a method of printing is disclosed. The printer includes a frame having a printing mechanism. The printing mechanism has an exterior surface, an inlet for receiving a leading edge of a film and an advancing mechanism. The printing mechanism also has a print head capable of depositing a plurality of ink droplets onto the advancing film and an outlet for allowing the printed film to exit. A lid is secured to the printing mechanism and is movable between a closed position, where the film is covered, and an open position, where the film is exposed. A first heating element is secured to the lid which heats the incoming air. A first fan is located adjacent to the first heating element and functions to direct the heated air onto the plurality of ink droplets. An inlet aperture is formed in the exterior surface of the printing mechanism which is aligned with the first fan. A cover having at least one opening formed there through is positioned over the inlet aperture. A baffle is positioned below the cover and has a plurality of openings formed there through. The baffle regulates the volume of air passing through the inlet aperture. A pair of second fans is positioned on either side of the print head for regulating the air temperature surrounding the print head. Lastly, a heater control unit is utilized to regulate the temperature of the first heating element.

20 Claims, 3 Drawing Sheets

(58) Field of Classification Search
USPC ..... 101/424.1
See application file for complete search history.

(56) References Cited

U.S. PATENT DOCUMENTS

| | | | | |
|---|---|---|---|---|
| 2,724,907 | A * | 11/1955 | Walter | B41F 23/0426 15/309.1 |
| 4,340,893 | A * | 7/1982 | Ort | B41J 11/002 101/424.1 |
| 4,841,903 | A * | 6/1989 | Bird | B41F 7/06 101/201 |
| 5,117,562 | A | 6/1992 | Dulay et al. | |
| 5,296,873 | A * | 3/1994 | Russell | B41J 2/1714 101/424.1 |
| 5,450,102 | A | 9/1995 | Ishida et al. | |
| 6,832,831 | B2 * | 12/2004 | Shima | B41J 11/0005 101/424.1 |
| 8,186,272 | B2 * | 5/2012 | Reichelsheimer | B41F 23/044 101/484 |
| 8,274,537 | B2 | 9/2012 | Howell et al. | |
| 8,477,163 | B2 | 7/2013 | Hirst | |
| 8,554,098 | B2 | 10/2013 | Nishiyama | |
| 8,746,871 | B2 | 6/2014 | Chiwata | |
| 8,786,649 | B2 | 7/2014 | Gao et al. | |
| 2002/0112628 | A1 * | 8/2002 | Irick | B41F 23/0436 101/424.1 |
| 2006/0054039 | A1 * | 3/2006 | Kritchman | B29C 41/02 101/424.1 |
| 2011/0267410 | A1 * | 11/2011 | Yamamoto | B41J 11/002 347/102 |
| 2013/0050370 | A1 | 2/2013 | Sasaki et al. | |
| 2014/0009547 | A1 | 1/2014 | Mizutani | |
| 2014/0210919 | A1 * | 7/2014 | Walker | B41J 11/002 347/102 |

FOREIGN PATENT DOCUMENTS

| | | |
|---|---|---|
| CN | 101638023 | 5/2011 |
| CN | 102229294 | 11/2011 |
| CN | 203472271 | 3/2014 |
| EP | 1987957 | 5/2008 |
| JP | 2009175339 | 8/2009 |
| JP | 04612884 | 1/2011 |
| JP | 201120318 | 2/2011 |
| JP | 04769527 | 9/2011 |
| JP | 05065719 | 11/2012 |
| JP | 05563508 | 7/2014 |
| KR | 2013103941 | 9/2013 |

* cited by examiner

PRINTER FOR PRINTING A FILM THAT CAN BE HYDROGRAPHICALLY PRINTED ONTO AN OBJECT AND A METHOD OF PRINTING

CROSS REFERENCE TO RELATED APPLICATION

This application claims priority as a Non-provisional application to Provisional application U.S. Ser. No. 62/147,114 filed Apr. 4, 2015.

FIELD OF THE INVENTION

This invention relates to a printer for printing a film that can later be hydrographically printed onto an object and a method of printing.

BACKGROUND OF THE INVENTION

Up until now, a film having a peel off backing layer could not be used for hydrographic printing because the plurality of ink droplets deposited onto the film during the printing process could not be dried fast enough to produce a stable and distinct image. Instead, the ink droplets would tend to pool and/or run on the surface of the film and create smudges, smears and blurs which would render the film unusable. Normally, a film having a backing layer is easier to handle than a film without a backing layer. In addition, a film having a backing layer can be rolled up on a supply roll and therefore is usually easier to store than a film without a backing layer. Those practicing hydrographic printing are asking for printed soluble films having a backing layer.

In the hydrographic printing process, the film is usually water soluble. The film can also be made from a biodegradable material. Polyvinyl acetate (PVA) and corn starch are the two most widely used materials to make a hydrographic film. After the soluble film is printed, it stored, usually in sheet form, until it is ready to be used. In starting the hydrographic process, a tank of water is usually heated to an elevated temperature, from between about 60° to about 100°. The soluble film is then placed on the surface of the water such that the film floats on the surface but is totally wetted by the water. An activating agent, such as a detergent or similar chemical, can be used to enhance the printing process. An object is then slowly lowered into the tank of water through the film, at an angle of about 25 to about 70 degrees. This action causes the image printed on the film to be transferred onto the outer surface of the object. In the hydrographic printing process, the water bath is used to biodegrade the soluble film, and the printed image becomes permanently secured to the outer surface of the object in a matter of seconds.

Now a printer has been invented that can print a soluble film which has a peel off backing layer.

In addition, improvements in films have now led to a number of new films which do not have a separate peel off backing layer but instead incorporate a soluble backing material onto the film itself. After these new films are printed, the image on the printed film can be transferred onto the outer surface of an object using the hydrographic printing process. In the hydrographic process, the printed film is again placed on the upper surface of an aqueous solution, such as water. The aqueous solution will cause the soluble backing material to dissolve before an object is dipped through the printed film. Once the film has been applied to the object, the object is removed from the aqueous solution, it is rinsed off and then is allowed to dry. The aqueous solution is used to dissolve the film leaving the printed image permanently attached to the outer surface of the object.

Now, a printer has been invented that can print a soluble film having a backing material incorporated onto the film itself.

SUMMARY OF THE INVENTION

Briefly, this invention relates to a printer capable of printing images on a soluble film that can be hydrographically printed onto an object, and a method of printing. The printer can be a high speed printer. The printer has a frame with a printing mechanism mounted thereon. The printing mechanism includes an exterior surface and has an inlet for receiving a leading edge of a film from a supply roll and a mechanism for advancing the film, at a controlled speed, through the printing mechanism. The printing mechanism also includes a print head capable of reciprocating on a horizontal rail above the advancing film. The print head is capable of emitting a plurality of ink droplets onto a surface of the film. The printing mechanism further includes an outlet for allowing the printed film to exit the printing mechanism and be taken up on a wind-up roll. The printing mechanism also includes a lid which encloses the film as it is routed through the printing mechanism. The lid is movable between a closed position, where the film is covered, and an open position, where the film is exposed. A first heating element is secured to the lid. The first heating element heats the surrounding air from room temperature to an elevated temperature. This hot air is needed to stabilize and dry the ink droplets which are deposited onto the advancing film, usually in a time period of about 15 seconds or less. The printing mechanism further includes a fan which is located adjacent to the first heating element. The fan directs and blows the hot air produced by the first heating element onto a select region of the advancing film. An inlet aperture is formed in the exterior surface of the printing mechanism and is aligned with the fan. A cover is positioned over this inlet aperture. The cover has at least one opening formed there through. A baffle is positioned below the cover and has a plurality of openings formed there through. The baffle regulates the volume of air passing through the inlet aperture to the fan. The printing mechanism further includes a pair of axial fans positioned on either side of the print head which regulate the air temperature surrounding the print head. The printing mechanism also includes a heater control unit which regulates the temperature of the first heating element. The heater control unit can be connected to a digital readout device which is mounted on the exterior surface of the printing mechanism. The heater control unit will provide the operator of the printer with the exact temperature of the air impinging on the advancing film.

The general object of this invention is to provide a printer capable of printing images on a soluble film that can later be hydrographically printed onto an object. A more specific object of this invention is to provide a method of printing a soluble film.

Another object of this invention is to provide a printer which can print images on a soluble film having a peel off backing layer.

A further object of this invention is to provide a printer which can print images on a soluble film having backing material incorporated onto a surface of the film.

Still another object of this invention is to provide a printer which can stabilize and dry ink droplets deposited onto a soluble film in a time period of about 15 seconds or less.

Still further, an object of this invention is to provide a method of printing images on a soluble film having a peel off backing layer or a backing material incorporated onto a surface of the film.

Other objects and advantages of the present invention will become more apparent to those skilled in the art in view of the following description and the accompanying drawings.

BRIEF DESCRIPTION OF THE DRAWINGS

FIG. 8 is a top view of a baffle having a plurality of first sized openings formed there through.

FIG. 9 is a top view of a baffle having a plurality of second sized openings formed there through.

FIG. 10 is a top view of a third baffle having a plurality of third sized openings formed there through.

DETAILED DESCRIPTION OF THE INVENTION

Figure 1:
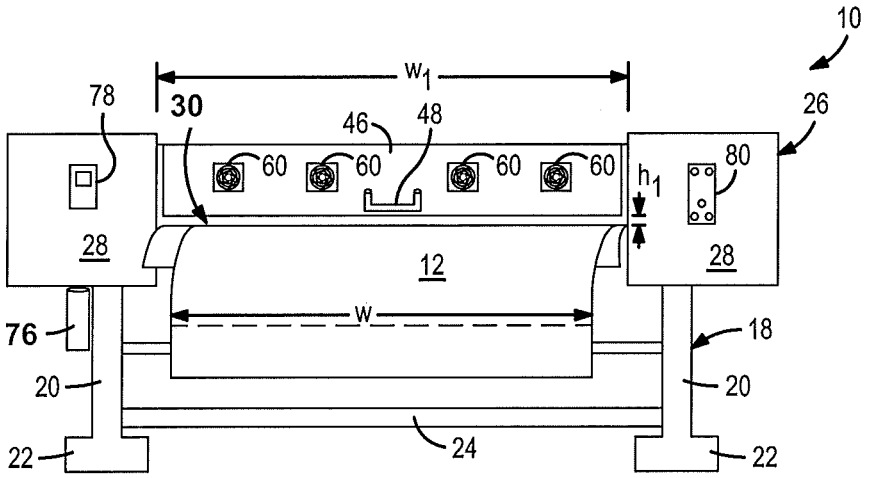
FIG. 1 is a front view of a printer.

Referring to FIG. 1, a printer 10 is shown. The printer 10 can vary in size, design, construction and speed. The printer 10 can be constructed and assembled by various manufacturers. The printer 10 can be designed to print 1, 2, 3, 4, 5, 6 or more different colors simultaneously. Desirably, the printer 10 can print at least four colors simultaneously. A Japanese company who manufacturers a variety of printers is Mutoh. Mutoh has a U.S. subsidiary known as Mutoh America, Inc. having an office at 2602 South 47$^{th}$ Street, Phoenix, Ariz. 85034. The Mutoh printers work well with this invention.

The printer 10 is capable of printing a film 12. The film 12 can vary in size, shape, thickness and composition. The film 12 can be any printable film known to those skilled in the art. The film 12 can be soluble. By "soluble" it is meant that it can be dissolved, especially easily dissolved. An aqueous solution, such as water, is normally used to dissolve the film 12. By "aqueous" it is meant relating to, similar to, containing, or dissolved in water. The film 12 can be solubilized. By "solubilized" it is meant to make (substances such as fats and lipids) soluble in water by the action of a detergent or similar agent.

The film 12 has a length (not shown), a width w and a thickness t. The length can range from about 1 foot to over 100 feet. The width w of the film 12 can also vary. Desirably, the width w of the film 12 is less than about 100 inches since most printers 10 are designed to handle a film 12 having a width w of less than about 8.3 feet. More desirably, the width w of the film 12 is less than about 64 inches. The thickness t of the film 12 can also vary. Typically, the film 12 has a thickness t of less than about 0.1 inches. Desirably, the thickness t of the film 12 is less than about 0.08 inches. More desirably, the thickness t of the film 12 is less than about 0.05 inches.

Figure 2:
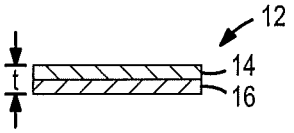
FIG. 2 is a cross-sectional view of a film having a peel off backing.

Referring to FIG. 2, the film 12 can consist of a single film layer 14 or the film 12 can be a laminate, consisting of two or more layers. In FIG. 2, the film 12 is depicted as a single film layer 14 having a peel off backing layer 16 temporarily secured to it. Both the film layer 14 and the backing layer 16 can be soluble in water or in a desired chemical. The backing layer 16 is designed to be removed, usually manually, before the film layer 14 is utilized. Desirably, the film layer 14 is to be used in a hydrographic printing process where an object can be printed. By "object" it is meant an individual thing or element; a particular item or article; something perceptible by one or more of the senses; a material thing. The object can vary in size, shape, configuration or design. An object can be anything known to mankind. An object can be natural, organic or be manmade.

Figure 3:
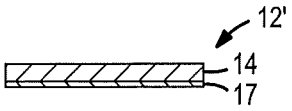
FIG. 3 is a cross-sectional view of a film having a backing material incorporated onto its lower surface.

Referring to FIG. 3, a film 12' is shown which consists of a single film layer 14 having a soluble backing material 17 incorporated onto one of its major surfaces. In FIG. 3, the soluble backing material 17 is incorporated onto the lower planar surface of the film layer 14. Alternatively, the film 12' could be a laminate and the soluble backing material 17 could be incorporated onto both major surfaces, if desired. The backing material 17 can be sprayed, brushed, coated, painted, stenciled or be applied some other way onto at least one major surface of the film layer 14. Various types and kinds of films 12 and 12' are commercially available from CMC Group having an office at 12836 South Dixie Highway Bowling Green, Ohio 43402.

It should be understood that a film layer 14 without a peel off backing layer 16 or without a backing material 17 incorporated onto a major surface of the film 12' can also be used. However, such film 12 is extremely sensitive to tearing and may have a tendency to buckle during the printing process when exposed to elevated temperatures.

Either of the films 12 or 12' can be used in a hydrographic printing process. The major surface of the film layer 14 which does not contain a backing layer 16 or have a soluble backing material 17 incorporated onto one of its major surfaces, is designed to receive a print medium (ink), usually in the form of a plurality of ink droplets. The opposite major surface of the film layer 14 can be secured to the peel off backing layer 16 or have a soluble backing material 17 incorporated thereon. The peel off backing layer 16 and the soluble backing material 17 function to provide stability to the film layer 14 prior to it being used in a hydrographic printing process. The peel off backing layer 16 and the soluble backing material 17 make the film 12 easier to handle, especially during storage and transport. A film layer 14 having a peel off backing layer 16 can be rolled up on a take up roll and be conveniently stored until needed. Roll products are also easy to ship by truck or rail. A film layer 14 with a soluble backing material 17 may be accumulated in sheet form and be manually or automatically stacked into bundles.

The exposed surface of the film layer 14 is designed to receive the print medium, usually in the form of ink droplets. This method of printing is commonly referred to as ink jet printing. The number of ink droplets deposited onto the film layer 14 can vary. Normally, in ink jet printing, a plurality of ink droplets is deposited onto the exposed surface of the film layer 14 very quickly and efficiently. Tens of thousands of ink droplets are deposited onto the film 12 quickly and efficiently. Printers 10 are commercially available today which can print from between about 500 square feet per hour to about 1,200 square feet per hour. Desirably, the printer 10 should be capable of printing from between about 600 square feet per hour to about 1,000 square feet per hour. The Mutoh "ValueJet 1624" printer is capable of printing up to 600 square feet per hour. The Mutoh "ValueJet 1638" printer is capable of printing up to 1,000 square feet per hour.

The ink droplets are usually applied to a surface of the film layer 14 in a moist or wet state. The ink droplets are then allowed to dry. High temperature air can assist with the drying process. It is important that the plurality of ink droplets dry very quickly, usually within 15 seconds or less so as to avoid having the ink droplets pool or run on the film 12. If the ink droplets are not adequately dried, smudges, smears and blurs can occur on the film layer 14, and such will render the print job unsatisfactory. When this occurs, the film layer 14 will have to be discarded.

The film 12 or 12' can vary in composition. The film 12 or 12' can be soluble in an aqueous solution, such as water, or some other chemical. A soluble film 12 or 12' is desirable when the film 12 or 12' is to be hydrographically printed onto an object. The reason for this is that the film 12 or 12' acts as a medium for transposing the printed image, created by the plurality of ink droplets, onto the object being printed.

The film 12 or 12' can also be constructed from a biodegradable material. By "biodegradable" it is meant that it is capable of being decomposed by biological agents, especially bacteria. Corn starch is one material from which the film 12 can be constructed. Corn starch is a starch prepared from corn grains. Another biodegradable material is polyvinyl acetate (PVA). Those skilled in the printing art are aware of other biodegradable materials from which the film 12 or 12' can be constructed.

Referring again to FIG. 1, the printer 10 includes a frame 18. The frame 18 can vary in size, shape, construction and design. As depicted in FIG. 1, the frame 18 includes a pair of spaced apart, upstanding legs 20, 20 each terminating in a foot 22, 22. Each foot 22, 22 is designed to provide stability and will contact or rest on a planar floor. The size, shape and configuration of each foot 22, 22 can vary. Usually, each foot 22, 22 is an enlarged member. The pair of upstanding legs 20, 20 can be joined together by one or more cross members 24 to add stability. The cross-members 24 can be aligned at a right angle to each of the pair of upstanding legs 20, 20 or be secured at some other angle thereto. One cross-member is shown in FIG. 1.

The printer 10 also includes a printing mechanism 26 which is mounted on the frame 18. The printing mechanism 26 has an exterior surface 28. The printing mechanism 26 also has an inlet 30 for receiving a leading edge of the film 12 or 12'. The size and shape of the inlet 30 can vary. Normally, the inlet 30 has a height $h_1$ and a width $w_1$. The height $h_1$ can range from about 0.5 inches to about 6 inches, while the width $w_1$ is slightly larger than the width w of the film 12 or 12'.

Figure 4:
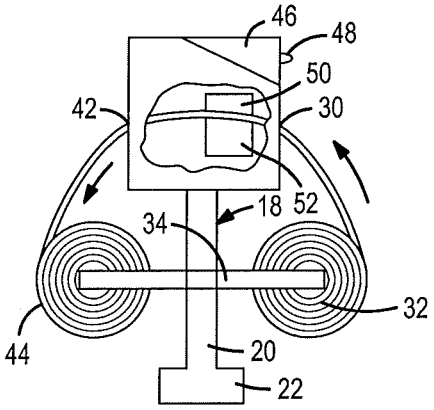
FIG. 4 is a side view of the printer shown in FIG. 1 and having a partial cut away view showing the first and second heating elements.

Referring to FIG. 4, the film 12 or 12' is usually supplied to the printing mechanism 26 in roll form. Alternatively, the film 12 or 12' can be supplied to the printing mechanism 26 in sheet form. When in sheet form, each sheet has to be manually or be automatically fed into the printing mechanism 26. Typically, the film 12 or 12' is wound on a supply roll 32. The supply roll 32 can vary in diameter. The supply roll 32 can be mounted onto the frame 18 using some kind of a support 34. The support 34 can consist of a pair of horizontal arms or bars which are designed to securely hold opposite ends of the supply roll 32. Alternatively, the supply roll 32 can be positioned adjacent to the printer 10 and be capable of rotating by any means known to those skilled in the art.

Figure 5:
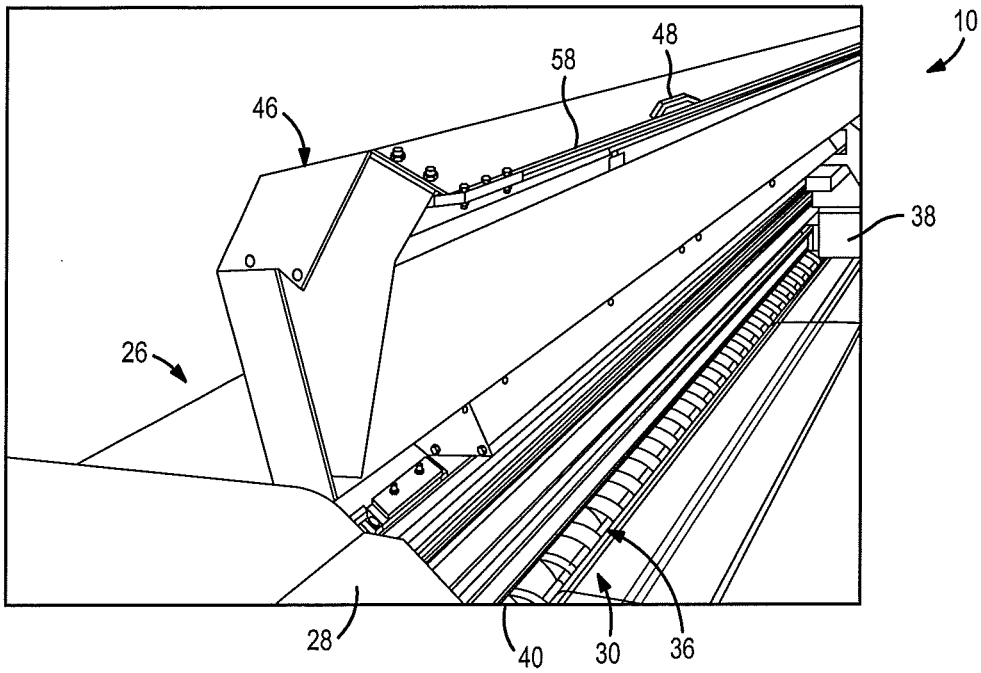
FIG. 5 is a perspective view of the printing mechanism with the lid shown in an open position.

Referring now to FIG. 5, the printing mechanism 26 also includes an advancing mechanism 36 for advancing the film 12 or 12', at a controlled speed through the printing mechanism 26. The film 12 or 12' can be advanced intermittently or at a variable speed through the printing mechanism 26. Typically, the film 12 or 12' is advanced intermittently through the printing mechanism 26 by the advancing mechanism 36. The advancing mechanism 36 can vary in construction and design. The advancing mechanism 36 can include a variety of belts, gears, rollers, guides, levers, etc. used to grasp and direct the film 12 or 12' through the printing mechanism 26. Such advancing mechanisms 36 are well known to those skilled in the art. The printing mechanism 26 further includes a print head 38 which is capable of reciprocating on a rail 40 located above the advancing film 12 or 12'. The rail 40 is usually horizontally aligned along the width $w_1$ of the printing mechanism 26. As the print head 38 reciprocates back and forth on the rail 40, it will deposit a plurality of ink droplets onto the advancing film 12 or 12'. The print head 38 can be designed and constructed to print at least one color. Desirably, the print head 38 can be designed and constructed to print multiple colors simultaneously. A print head 38 could be constructed to print 2, 3, 4, 5, 6 or more colors simultaneously. Desirably, the print head 38 is capable of printing at least four colors simultaneously.

The printing mechanism 26 is normally designed to operate at a humidity of less than about 70%. By "humidity" it is meant dampness, especially of the air. Desirably, the printing mechanism 26 is designed to operate at a humidity ranging from between about 20% to about 60%. More desirably, the printing mechanism 26 is designed to operate at a humidity ranging from between about 40% to about 60%.

Referring again to FIG. 4, the printing mechanism 26 also includes an outlet 42 for allowing the printed film 12 or 12' to exit the printing mechanism 26. The outlet 42 can be aligned opposite to the inlet 30 or be in some other location. The outlet 42 can be on the same plane as the inlet 30 or be located above or below the plane of the inlet 30. The printed film 12 will contain the peel off backing layer 16 and the printed film 12' will contain the soluble backing material 17 during the printing process through the printer 10. The printed film 12 can be wound up on a wind-up roll 44. The diameter of the wind-up roll 44 can vary. The printed film 12' can also be wound up on a wind-up roll or it can be accumulated in sheet form.

Referring again to FIGS. 1 and 5, the printing mechanism 26 also includes a lid 46 which is movably secured to the printing mechanism 26. Desirably, the lid 46 can pivot or rotate on the printing mechanism 26. Those skilled in the mechanical arts are well aware of various ways to pivot or rotate the lid 46 relative to the printing mechanism 26. The lid 46 is movable between a closed position, where the film 12 or 12' is covered, and an open position, where the film 12 or 12' is exposed. Desirably, the lid 46 can pivot or rotate through an angle of at least about 90 degrees. More desirably, the lid 46 can pivot or rotate through an angle of at least about 135 degrees. Even more desirably, the lid 46 can pivot or rotate through an angle of at least about 180 degrees. Most desirably, the lid 46 can pivot or rotate through an angle of greater than about 180 degrees.

The lid 46 contains a handle 48 which provides a means for an operator to easily grasp and move, pivot or rotate the lid 46 between its open and closed positions. Desirably, the handle 48 is centered on the lid 46. The size, shape and material from which the handle 48 is constructed can all vary.

Figure 6:
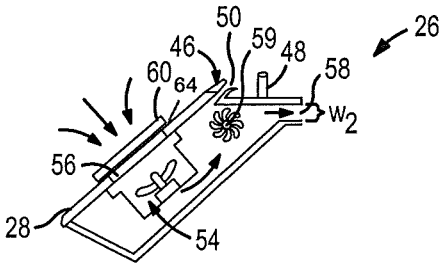
FIG. 6 is a partially side view of the movable lid showing an aperture formed there through, a baffle, and a cover secured to the exterior of the aperture, and a fan secure to the interior of the aperture.

Referring now to FIGS. 4 and 6, the printing mechanism 26 further includes a first heating element 50 secured to and located within the lid 46. The first heating element 50 can vary in construction and design. Those skilled in the art are well aware of several different commercially available heating elements 50. For example, the first heating element 50 can be an electrical coil connected to a heat source, such as an electrical current, via an electrical cord. The first heating element 50 is positioned in the lid 46 above the advancing film 12, see FIG. 4. The first heating element 50 functions to heat the incoming air, which is usually at room temperature, into the printing mechanism 26. Room temperature air is usually about 70° F.±5° F. The first heating element 50 needs to elevate the room temperature air to a temperature of at least about 160° F. Desirably, the first heating element 50 will elevate the room temperature air to a temperature ranging from between about 160° F. to about 220° F. More desirably, the first heating element 50 will elevate the room temperature air to a temperature ranging from between about 170° F. to about 212° F. Even more desirably, the first heating element 50 will elevate the room temperature air to a temperature ranging from between about 175° F. to about 210° F. This heated air is needed to quickly dry the plurality of ink droplets deposited onto the film layer 14 of the advancing film 12. This elevated temperature will ensure that the plurality of ink droplets dry in a very short period of time. The time period should be less than about 20 seconds. Desirably, the time period is less than about 15 seconds. Even more desirably, the time period is less than about 12 seconds. Most desirably, the time period is less than about 10 seconds.

It should be understood that one could employ two or more first heating elements 50, if desired. If the printer 10 is large, it may be advantageous to utilize two or more first heating elements 50, 50.

Referring back to FIG. 4, the printing mechanism 26 can optionally include a second heating element 52 which is located below the advancing film 12. The second heating element 52, when present, warms the lower surface of the advancing film 12 and thereby reduces the amount of heat that may be drawn away from the film 12. The second heating element 52 is capable of heating the peel off backing layer 16 or the soluble backing material 17, along with any closely associated guides. The peel off backing layer 16 or the soluble backing material 17 can act as an insulating layer in the film 12. By raising the temperature of the peel off backing layer 16 or the soluble backing material 17, one can reduce the amount of heat that will be drawn away from the film 12 as it is heated by the hot incoming air from the first heating element 50. Therefore, the use of both the first and second heating elements, 50 and 52, is preferred.

Still referring to FIG. 4, the second heating element 52 is located below the advancing film 12. The second heating element 52 is also located in close proximity to the first heating element 50. The second heating element 52 is set to a lower temperature value than the first heating element 50. For example, the second heating element 52 can be set to increase the temperature of the incoming air to a temperature of about 100° F. One reason why the first heating element 50 needs to generate a higher air temperature than the second heating element 52 is that this hot air is needed to dry the plurality of ink droplets deposited onto the film layer 14. The ink droplets need to be dried very quickly. This means that the hot air from the first heating element 50 must be at a temperature of at least about 160° F. The second heating element 52, on the other hand, only needs to raise the temperature of the peel off backing layer 16 or the soluble backing material 17, and the associated equipment, a small amount so that no heat sink is present within the printing mechanism 26.

As stated above relative to the first heating element 50, one could utilize two or more second heating elements 52, 52, if desired.

Referring again to FIGS. 4-6, the printing mechanism 26 further includes a first fan 54 located within the lid 46 and positioned adjacent to the first heating element 50. The first fan 54 can operate at a constant speed fan or at variable speeds. Desirably, the first fan 54 is a constant speed fan. The size, shape and configuration of the first fan 54 can vary. One skilled in the mechanical arts is aware of different fans that can be used. The first fan 54 functions to draw air through an inlet aperture 56 formed in the exterior surface 28 of the printing mechanism 26. Desirably, the inlet aperture 56 is formed through the lid 46. The inlet aperture 56 can vary in size and shape. Desirably, the inlet aperture 56 is circular in configuration and has a diameter of from between about 2 inches to about 6 inches. More desirably, the inlet aperture 56 has a diameter of between about 3 inches to about 5 inches. The inlet aperture 56 can be aligned with the first fan 54. For example, the inlet aperture 56 can be axially aligned with the first fan 54. Alternatively, the inlet aperture 56 can be located at an angle to the first fan 54 or be offset from the first fan 54. Room temperature air is drawn into the inlet aperture 56 of the lid 46 by the first fan 54. This incoming air is then passed around and/or through the first heating element 50 wherein the incoming air is heated to an elevated temperature of at least about 160° F. Desirably, the temperature of the air is elevated to a range of from between about 170° F. to about 220° F. More desirably, the temperature of the air is elevated to a range of from between about 180° F. to about 220° F. Even more desirably, the temperature of the air is elevated to a range of from between about 185° F. to about 220° F. This heated air is then funneled through an elongated slot 58. The elongated slot 58 is depicted as an elongated, narrow rectangle having a length less than the width $w_1$ of the inlet 30. The elongated slot 58 has a width $w_2$ which is measured perpendicular to its length. The width $w_2$ of the elongated slot 58 is about 1 inch or less. Desirably, the width $w_2$ of the elongated slot 58 is less than about 0.5 inches. More desirably, the width $w_2$ of the elongated slot 58 is less than about 0.25 inches. Even more desirably, the width $w_2$ of the elongated slot 58 is less than about 0.2 inches. Most desirably, the width $w_2$ of the elongated slot 58 is less than about 0.13 inches. The elongated slot 58 is positioned to direct the heated air from the first heating element 50 onto the plurality of ink droplets deposited onto the upper surface of the advancing film 12.

Referring to FIG. 6, in printers 10 which can advance the film 12 at high intermittent speeds, it may be advantageous to form a second slot 59, located downstream of the elongated slot 58. Additional heated air can pass through the second slot 59 and assist in drying the ink which has been deposited onto the film 12. The exact spacing of the second slot 59 can vary. Typically, the second slot 59 will be located downstream and within about 1 to about 6 inches of the elongated slot 58. Desirably, the second slot 59 is located downstream and within about 1.5 inches to about 3 inches from the elongated slot 58. The second slot 59 can be a single slot or consist of two or more spaced apart openings. The second slot 59 can have various size openings. Desirably, the second slot 59 has an opening of at least about 0.10 inches. More desirably, the second slot 59 has an opening of at least about 0.15 inches. More desirably, the second slot 59 has an opening which ranges from between about 0.10 inches to about 0.50 inches. The heated air passing through the second slot 59 will aid in drying the ink deposited onto the film 12.

It should be understood that two or more inlet apertures 56, 56 could be formed in the lid 46 of the printing mechanism 26, if desired. The two or more inlet apertures 56, 56 should be spaced apart to provide a sufficient air flow. With two or more inlet apertures 56, 56, one would utilize a first fan 54 with each of the inlet apertures 56, 56.

Figure 7:
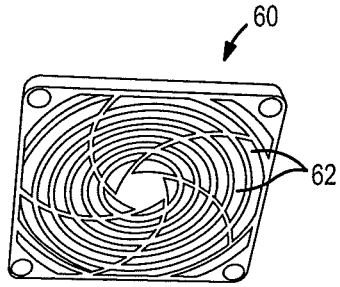
FIG. 7 is a perspective view of a cover.

Referring now to FIGS. 1, 6 and 7, the printing mechanism 26 further includes a cover 60 positioned over the exterior of the inlet aperture 56. The cover 60 has at least one opening 62 formed there through. The cover 60 can be secured to the exterior surface 28 of the printing mechanism 26 by various mechanical fasteners, including but not limited to: machine screws, clips, snaps, rivets, bolts, nuts, pins, etc. or by a chemical fastener, such as an adhesive, glue, epoxy, etc. By "epoxy" it is meant any of various usually thermosetting resins capable of forming tight cross-linked polymer structures characterized by toughness, strong adhesion, and low shrinkage, used especially in adhesives. The cover 60 has at least one opening 62 formed there through. Desirably, the cover 60 has multiple openings 62 formed there through. The openings 62 formed through the cover 60 can be decorative and aesthetically pleasing to the eye. In FIG. 7, the cover 60 is depicted as having multiple openings 62 formed in a decorative swirl pattern. The openings 62 can be of any size, shape, design or configuration. The openings 62 should be sufficiently large to allow an appropriate amount of air to pass through the inlet aperture 56 to the first fan 54.

Referring again to FIGS. 1 and 6, four (4) covers 60, 60, 60 and 60 are shown in FIG. 1. Each of the covers 60, 60, 60 and 60 is secured above an inlet aperture 56, 56, 56 and 56, see FIG. 6, and each of the inlet apertures 56, 56, 56 and 56 has a first fan 54 aligned below it, see FIG. 6. Desirably, two or more inlet apertures 56, 56 and two or more first fans 54, 54 are utilized with each printing mechanism 26, especially when the width $w_1$ of the inlet 30 exceed 50 inches.

Figure 8:
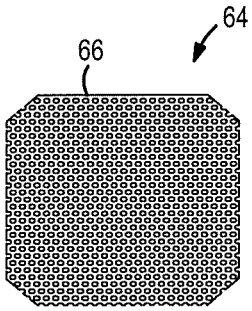

Referring now to FIGS. 6 and 8, the printing mechanism 26 also includes a baffle 64, see FIG. 8. By "baffle" it is meant a static device that regulates the flow of air. The baffle 64 is positioned below the cover 60. The baffle 64 is aligned with the inlet aperture 56, see FIG. 6. If more than one inlet aperture 56 and cover 60 are present in the lid 46, then a baffle 64 is associated with each of the inlet apertures 56, 56 and the covers 60, 60. The baffle 64 should be slightly larger in dimensions than the inlet aperture 56 and can be held in place by being sandwiched between the cover 60 and the exterior surface 28 of the printing mechanism 26. The baffle 64 has a plurality of openings 66 formed there through. The exact number of the openings 66 formed in the baffle 64 can vary. Likewise, the size, shape and arrangement of the openings 66 can vary. Desirably, the baffle 64 contains fifty (50) or more openings 66. More desirably, the baffle 64 contains seventy-five (75) or more openings 66. Even more desirably, the baffle 64 contains a hundred (100) or more openings 66. Most desirably, the baffle 64 contains a hundred and fifty (150) or more openings 66. The baffle 64 functions to regulate the volume of air passing through the inlet aperture 56 to the first fan 54. The baffle 64 can be formed from a variety of materials. The baffle 64 can be formed from a metal, an alloy of two or more metallic elements, steel, aluminum, titanium, magnesium, a mesh screen, a plastic, a thermoplastic, etc.

It should be understood that the open area created by the openings 66 formed through the baffle 64 is smaller or less than an open area created by the openings 62 formed in the cover 60. This means that the baffle 64 control the volume of air passing through to the first fan 54.

Figure 9:
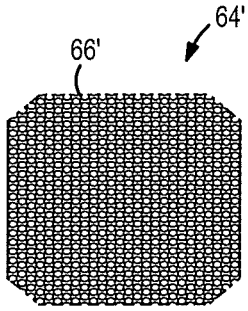
Figure 10:
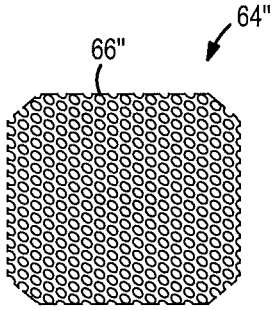

Referring now to FIGS. 9 and 10, two alternative embodiments of baffles 64' and 64" are shown. The baffle 64' is similar to the baffle 64 except that it contains a fewer number of larger size openings 66'. The larger size openings 66' in the baffle 64' are also arranged in a different pattern than is depicted for the baffle 64. In FIG. 10, the baffle 64" is similar to the baffle 64 except that it contains a fewer number of yet larger size openings 66'. The larger size openings 66" in the baffle 64" are also arranged in a different pattern than is depicted in either of the baffles 64 or 64'.

It should be understood that the openings 66, 66' and 66" can be uniformly or randomly arranged in the respective baffles 64, 64' and 64". The exact design or pattern of the openings 66, 66' or 66" can vary.

Figure 11:
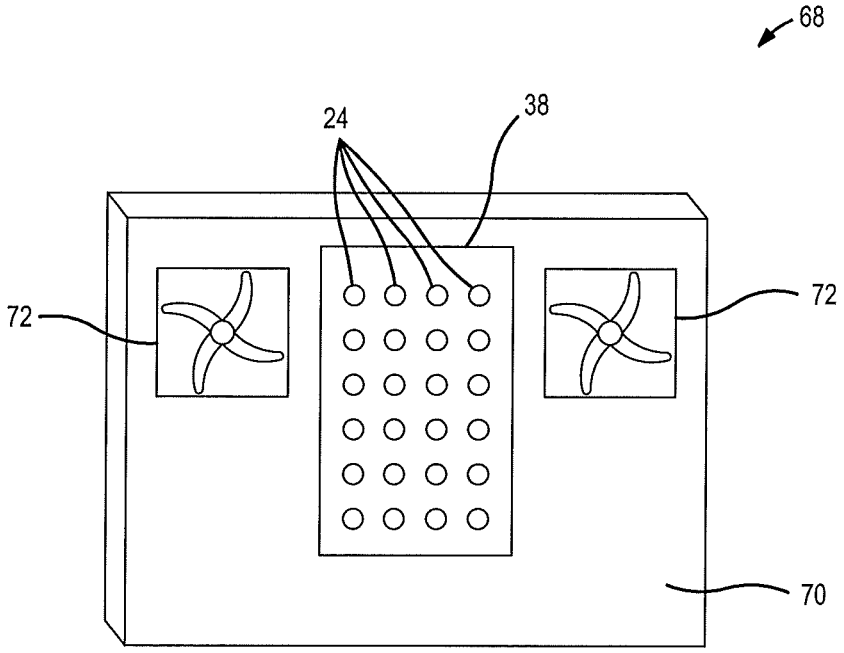
FIG. 11 is a perspective view of the interior of a print cursor assembly showing a pair of axial fans positioned on opposite sides of the print head.

Referring now to FIG. 11, the printing mechanism 26 further includes a print cursor assembly 68 having an inside surface 70. The print head 38 is secured to the inside surface 70 of the print cursor assembly 68. Desirably, the print head 38 is positioned approximately in the center of the inside surface 70 of the print cursor assembly 68. A pair of second fans 72, 72 is positioned on either side of the print head 38. The exact spacing at which the pair of second fans 72, 72 is spaced from the print head 38 can vary. Also the size of each of the pair of second fans 72, 72 can vary. Each of the pair of second fans 72, 72 can operate at a constant speed or at variable speeds. Desirably, each of the pair of second fans 72, 72 is a constant speed fan. The pair of second fans 72, 72 functions to regulate the air temperature surrounding the print head 38. It is important that the temperature surrounding the print head 38 stays below a safe operating temperature for the print head 38. If the print head 38 is subjected to an elevated temperature, above its normal operating temperature, it could cause the print head 38 to malfunction or break. The pair of second fans 72, 72 will push the warm air, present in the printing mechanism 26 below the lid 46, out of and away from the print head 38. This action will allow the print head 38 to operate within its acceptable temperature range.

It should be noted that various, commercially available print heads 38 will operate at different temperature ranges.

Still referring to FIG. 11, the print head 38 is shown having a plurality of orifices 74. A standard print head 38 can contain up to 1,440 orifices 74. If the print head 38 is set up to dispense two or more colors simultaneously, then the print head 38 would include two or more separate channels (not shown). Each channel would be connected to a number of the orifices 74. For example, if the print head 38 was to dispense four (4) different colors simultaneously, then 360 of the 1,440 orifices 74 would be connected to each color reservoir. The four colors could be cyan, magenta, yellow and black. Cyan is a greenish blue, considered a primary color in printing and photography. Magenta is a moderate to vivid purplish red. Yellow is a hue resembling that of ripe lemons and is one of the subtractive primary colors. Black is produced by reflecting comparatively little light and has no predominant hue.

The orifices 74 are closely located relative to one another. Typically, the orifices 74 are arranged in rows that are spaced only a few thousands of an inch apart. A computer will control the timing and size of the ink droplets dispensed from each of the orifices 74. All of the orifices 74 do not emit an ink droplet simultaneously hut instead the orifices 74 are choreographed to create the desired image on the film 12 or 12'. Those skilled in the ink jet printing art will be familiar with the construction and operation of the print head 38.

Referring again to FIG. 1, the printing mechanism 26 further includes a heater control unit 76 which regulates the temperature of the first heating element 50. The heater control unit 76 is depicted as a box secured to the frame 18. However, the heater control unit 76 could be positioned within the printing mechanism 26 or in some other location on the printer 10. The heater control unit 76 is electrically connected to the first heating element 50. Optionally, the heater control unit 76 could also be electrically connected to the second heating element 52. Another option is to connect the heater control unit 76 to both of the first and second heating elements, 50 and 52 respectively.

Still referring to FIG. 1, the printing mechanism 26 can also include a digital readout device 78. The digital readout device 78 can be secured to the exterior surface 28 of the printing mechanism 26. The digital readout device 78 can be set up to record one or more variables. For example, the digital readout device 78 could record the air temperature above the advancing film 12 or 12', the air temperature below the advancing film 12 or 12', etc. Various digital readout devices 78 are commercially available and are well known to those skilled in the control arts.

Lastly, the printing mechanism 26 can also include a control panel 80. The control panel 80 can vary in size, shape and information displayed thereon. The control panel 80 can contain an on/off switch, an emergency stop button, lights which indicate when the printer 10 is in a warm up phase, a run mode, an idle mode, etc. The control panel 80 can also include various digital readout devices 78.

After the film 12 or 12' is printed, it can be wound up onto a wind-up roll 44 or it can be accumulated in sheet form. The diameter of the wind-up roll 44 can vary. The filled wind-up roll 44 can be sent to a warehouse for storage. Alternatively, the filled wind-up roll 44 can be immediately transferred to a manufacturing or production facility where it will be utilized. Likewise, the film 12 or 12' in sheet form can be placed in storage or be used immediately.

At the manufacturing or production facility, if the film 12 contains a peel off backing layer 16, this layer 16 is removed from the film 12 before the film 12 is positioned in a tank containing a water based solution, i.e. water, in preparation of hydrographically printing an object. In the hydrographic printing process, the film layer 14 is placed on the surface of the water such that the film layer 14 is completely wetted. The water is usually raised to a temperature above room temperature before the film layer 14 is positioned on the surface of the water. An object to be printed is then manually dipped through the film layer 14 and into the water until it is completely immersed. The object is then removed from the tank of water and the image that was printed on the film layer 14 will be transferred onto the object. The object is then allowed to dry.

When the film 12' includes a soluble backing material 17, the entire film 12' can be positioned on the surface of the water in the tank. The entire film 12' can be wetted by the water. The water will dissolve the soluble backing material 17. Once the soluble backing material 17 and the PVA film has dissolved, the object to be printed is manually dipped through the film layer 14 and into the water until it is completely immersed. The object is then removed from the tank of water and the image that was printed on the film layer 14 will be transferred onto the object. The object is rinsed and then allowed to dry.

Method

A method of printing is also taught. The method includes the steps of advancing a film 12 or 12' from a supply roll 32 through a printer 10. The printer 10 includes a printing mechanism 26 mounted on a frame 18. The printed film 12 or 12' is withdrawn from the supply roll 32, advanced through the printer 10, usually in an intermittent fashion, and then is recovered on a wind-up roll 44 or alternatively in sheet form. The printing mechanism 26 has an exterior surface 28. The printing mechanism 26 also has an inlet 30 for receiving a leading edge of the film 12 or 12'. The printing mechanism 26 further has an advancing mechanism 36 for routing and advancing the film 12 or 12', at a controlled speed and usually in an intermittent fashion, through the printing mechanism 26. A print head 38 is movably positioned in the printing mechanism 26 and is capable of reciprocating on a rail 40 located above the advancing film 12 or 12'. The print head 38 deposits a plurality of ink droplets onto the advancing film 12 or 12'. The film 12 or 12' is usually stopped when it is being printed. The printing mechanism 26 also includes an outlet 42 for allowing the printed film 12 or 12' to exit the printing mechanism 26.

The method also includes securing a lid 46 to the printing mechanism 26. The lid 46 is movable between a closed position, where the film 12 or 12' is covered, and an open position, where the film 12 or 12' is exposed. The lid 46 can pivot, rotate or be constructed to move in some other fashion. A first heating element 50 is secured in the lid 46. The first heating element 46 is capable of heating the incoming air routed above the upper surface of the film 12 or 12'. Two or more first heating elements 50, 50 can be utilized, if desired.

The method further includes positioning a first fan 54 adjacent to the first heating element 50. The first fan 54 will direct the heated air onto the plurality of ink droplets which were deposited onto the film 12 or 12'. An inlet aperture 56 is formed in the exterior surface 28 of the printing mechanism 26. Two or more inlet apertures 56, 56 can be utilized. Each of the inlet apertures 56, 56 is aligned with one of the first fans 54, 54. A cover 60 is positioning over each of the inlet apertures 56, 56. The cover 60 has at least one opening 62 formed there through. A baffle 64, 64' or 64''' is positioning below the aperture cover 60. The baffle 64, 64' or 64'' has a plurality of openings formed there through which regulate the volume of air passing through each of the inlet apertures 56, 56 to each of the first fans 54, 54. The hot air from the first heating element 50 is then directed through an elongated slot 58 so that it directly contacts the ink droplets which were deposited on the upper surface of the film layer 14.

If a second slot 59 is present, it is located downstream of the elongated slot 58. Additional heated air can be directed through the second slot 59 and onto the printed film 12 or 12'. This heated air will aid in drying the ink deposited onto the film 12 or 12'.

The method further includes positioning a pair of second fans 72, 72 on either side of the print head 38 to regulate the air temperature surrounding the print head 38. Lastly, a heater control unit 76 is secured to the printer 10 to regulate the temperature of the first heating element 50. The heater control unit 76 is electrically connected to the first heating element 50. The method can further include attaching one or more digital readout devices 78 and/or a control panel 80 to the printer 10.

While the invention has been described in conjunction with several specific embodiments, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

I claim:

1. A printer for printing a film that can later be hydrographically printed onto an object, comprising:

a) a frame;

b) a printing mechanism mounted on said frame and having an exterior surface, said printing mechanism having an inlet for receiving a leading edge of a film, advancing means for advancing said film at a controlled speed through said printing mechanism, a print head capable of reciprocating on a rail located above said advancing film and depositing a plurality of ink droplets onto said advancing film, and an outlet for allowing said printed film to exit said printing mechanism;

c) a lid secured to said printing mechanism, said lid being movable between a closed position, where said film is covered, and an open position, where said film is exposed;

d) a first heating element secured to said lid which heats incoming air;

e) a first fan located adjacent to said first heating element which directs said heated air onto said plurality of ink droplets deposited onto said advancing film;

f) an inlet aperture formed in said exterior surface of said printing mechanism which is aligned with said first fan;

g) a cover positioned over said inlet aperture, said aperture cover having at least one opening formed there through which creates an open area;

h) a baffle positioned below said cover and having a plurality of openings formed there through, and said baffle regulating the volume of air passing through said inlet aperture to said first fan;

i) a pair of second fans positioned on either side of said print head for regulating the air temperature surrounding said print head; and j) a heater control unit which regulates the temperature of said first heating element.

2. The printer of claim 1 further comprising a digital readout device secured to said exterior surface of said printing mechanism, said digital readout device recording air temperature above said advancing film.

3. The printer of claim 1 wherein a second heating element is positioned below said advancing film.

4. The printer of claim 3 wherein said first heating element operates at a higher temperature than said second heating element.

5. The printer of claim 4 wherein said first heading element can heat said incoming air to a temperature of at least about 160° F.

6. The printer of claim 1 further comprising an elongated slot positioned in said lid below, said first heating element, through which heated air is directed onto said plurality of ink droplets.

7. The printer of claim 1 wherein said printing mechanism can print from between about 600 square feet per hour to about 1,000 square feet per hour, and the air temperature above said advancing film ranges from between about 170° F. to about 220° F.

8. The printer of claim 1 wherein said printing mechanism can print four different colors simultaneously, and said printing mechanism operates at a humidity ranging from between about 40% to about 60%.

9. The printer of claim 1 wherein said openings formed through said baffle create an open area which is less than an open area created by said openings formed through said cover.

10. A printer for printing a film that can later be hydrographically printed onto an object, comprising:

a) a frame;

b) a printing mechanism mounted on said frame and having an exterior surface, said printing mechanism having an inlet for receiving a leading edge of a film, advancing means for advancing said film at a controlled speed and intermittently through said printing mechanism, a print head capable of reciprocating on a rail located above said advancing film and depositing a plurality of ink droplets onto said advancing film, and an outlet for allowing said printed film to exit said printing mechanism;

c) a lid secured to said printing mechanism, said lid being movable between a closed position, where said film is covered, and an open position, where said film is exposed;

d) a pair of first heating elements secured to said lid, each of said pair of first heating elements capable of heating the incoming air;

e) an elongated slot positioned in said lid below said pair of first heating elements;

f) at least two first fans located adjacent to said pair of first heating elements which direct said heated air through said elongated slot and onto said plurality of ink droplets deposited onto said advancing film;

g) at least two inlet apertures formed in said exterior surface of said printing mechanism, each of said inlet apertures being aligned with one of said at least two first fans;

h) a pair of covers, each positioned over one of said at least two inlet apertures, each of said pair of covers having at least one opening formed therethrough;

i) a baffle positioned below each of said covers and having a plurality of openings formed therethrough, each of said baffles regulating the volume of air passing to each of said at least two first fans;

j) a pair of second fans positioned on either side of said print head for regulating the air temperature surrounding said print head; and k) a heater control unit which regulates the temperature of said pair of first heating elements.

11. The printer of claim 10 wherein said film is withdrawn from a supply roll and is advanced through said printing mechanism to a wind-up roll, and said pair of first heating elements can heat the incoming air to a temperature of at least about 160° F.

12. The printer of claim 11 wherein said pair of first heating elements can heat the surrounding air to a temperature of from between about 160° F. to about 220° F.

13. The printer of claim 10 wherein a second slot is formed in said lid, downstream of said elongated slot, and heated air exiting said pair of first heating elements through said elongated slot and through said second slot will cause said plurality of ink droplets deposited onto said advancing film to dry within about 15 seconds.

14. The printer of claim 10 wherein said film is a soluble film having a peel off backing layer.

15. The printer of claim 10 wherein said film is a soluble film having a soluble backing material incorporated onto a surface of said soluble film.

16. A method of printing a film comprising the steps of:

a) advancing a film from a supply roll through a printing mechanism which is mounted on a frame, said printing mechanism printing said film, and recovering said printed film on a wind-up roll, said printing mechanism having an exterior surface, said printing mechanism having an inlet for receiving a leading edge of said film, advancing means for advancing said film at a controlled speed through said printing mechanism, a print head capable of reciprocating on a rail located above said advancing film and depositing a plurality of ink droplets onto said advancing film, and an outlet for allowing said printed film to exit said printing mechanism;

b) securing a lid to said printing mechanism, said lid being movable between a closed position, where said film is covered, and an open position, where said film is exposed;

c) securing a first heating element to said lid which is capable of heating incoming air;

d) positioning a first fan adjacent to said first heating element which directs said heated air onto said plurality of ink droplets deposited onto said advancing film;

e) forming an inlet aperture in said exterior surface of said printing mechanism which is aligned with said first fan;

f) positioning a cover over said inlet aperture, said cover having at least one opening formed there through;

g) positioning a baffle below said cover, said baffle having a plurality of openings formed there through which regulate the volume of air passing to said first fan;

h) positioning a pair of second fans on either side of said print head for regulating the air temperature surrounding said print head; and i) utilizing a heater control unit to regulate the temperature of said first heating element.

17. The method of claim 16 further comprising forming an elongated slot in said lid below said first heating element through which said heated air is directed onto said plurality of ink droplets deposited onto said advancing film.

18. The method of claim 16 wherein said film is a soluble film having a peel off backing or a soluble film having a soluble backing material incorporated onto a surface of said soluble film.

19. The method of claim 16 wherein said first heading element can heat said incoming air to a temperature of from between about 160° F. to about 220° F.

20. The method of claim 16 wherein said plurality of ink droplets are dried within about 15 seconds.

* * * * *